United States Patent [19]

Holloway et al.

[11] 3,954,530

[45] May 4, 1976

[54] IGNITABLE COMPOSITIONS COMPRISING LEAD MONOXIDE AND BORON

[75] Inventors: Kenneth John Holloway, Welling; George William Charles Taylor, Waltham Abbey; Arwyn Theophilus Thomas, Orpington, all of England

[73] Assignee: Ministry of Defence, London, England

[22] Filed: Mar. 7, 1967

[21] Appl. No.: 621,366

[52] U.S. Cl. ..... 149/22

[51] Int. Cl.[2] ..... C06B 43/00

[58] Field of Search ..... 149/22, 20; 102/70, 102/27

[56] References Cited

UNITED STATES PATENTS

| | | | |
|---|---|---|---|
| 2,717,204 | 9/1955 | Noddin et al. | 149/22 |
| 2,991,714 | 7/1961 | Noddin | 149/22 X |
| 3,159,512 | 12/1964 | Herz | 149/22 |
| 3,286,628 | 11/1966 | Young et al. | 149/22 X |
| 3,317,360 | 5/1967 | Young et al. | 149/22 X |

FOREIGN PATENTS OR APPLICATIONS

| | | | |
|---|---|---|---|
| 516,947 | 9/1955 | Canada | 149/22 |

*Primary Examiner*—Leland A. Sebastian

[57] ABSTRACT

Crystalline lead monoxide is precipitated around an aqueous suspension of boron particles to form an ignitable composition having uniform, reproducible properties and good resistance to shock, heat and friction.

9 Claims, No Drawings

IGNITABLE COMPOSITIONS COMPRISING LEAD MONOXIDE AND BORON

The invention relates to improvements in the manufacture of ignitable compositions containing lead monoxide.

The oxides of lead, especially lead dioxide ($PbO_2$) and red lead ($Pb_3O_4$), have been employed as oxidising ingredients of pyrotechnic and fusehead compositions. In general, these compositions consist of admixtures, prepared by mechanical mixing, of at least one of the lead oxides with powdered fuels and other materials. Such prior compositions have been unsatisfactory in that normal mechanical mixing of the components of the compositions fails to intersperse the components uniformly and the resulting compositions do not function reproducibly and are undesirably sensitive to friction or mechanical shock.

The present invention provides ignitable compositions containing lead monoxide in which the major components of the composition are intimately interspersed to give extremely uniform and reproducible compositions which function consistently and reliably. The ignitable compositions have good igniferous properties so that when ignited they will readily ignite an adjacent element in a firing train, and the rate of burning and the consistent functioning of the compositions enable them to be used advantageously as delay compositions. Furthermore, when desired the compositions may be readily ignited by flame, they are surprisingly resistant to accidental ignition by friction or mechanical shock, and exhibit good thermal stability.

According to the invention, ignitable compositions are provided which comprise crystalline lead monoxide in which finely divided elemental boron is entrained within, and substantially dispersed throughout, individual lead monoxide crystals. Ignitable compositions in accordance with the invention may be prepared by forming crystalline lead monoxide in aqueous solution in the presence of a suspension of finely divided boron.

The preferred process for preparing the ignitable compositions comprises precipitating lead monoxide from aqueous solution by reacting a soluble lead salt and an alkali in a stirred aqueous suspension of finely divided boron. The polymorphic crystal form of the ignitable compositions may be altered by adjustment of the conditions of precipitation to give low bulk density compositions, corresponding to boron-containing orthorhombic lead monoxide crystals, or high bulk density compositions, corresponding to boron-containing tetragonal lead monoxide crystals.

Advantageously, the proportion of finely divided boron entrained in the lead monoxide in the ignitable compositions is up to about 10 percent by weight and most usefully between about 2 and 4 percent by weight. The yield of ignitable compositions prepared by the preferred process is high, generally representing about 98 percent of the theoretical yield of lead monoxide. Substantially all of the finely divided boron in suspension is entrained by the precipitating lead monoxide so that only the actual weight of boron finally required in the ignitable composition need be present in suspension during precipitation.

The particle size of the finely divided boron is not critical to the achievement of the invention provided of course that the particle size is considerably less than the size of the lead monoxide crystals in which the boron is entrained. Normally, boron particle sizes of the order of 1 micron are satisfactory.

The soluble lead salts used in the preferred process for manufacturing the ignitable compositions in accordance with the invention are lead nitrate and lead acetate and the preferred alkali reacted with these salts is sodium hydroxide.

The precipitation is preferably carried out at an elevated temperature, a suitable range being 80° – 100°C.

By intimately combining a relatively mild oxidant, lead monoxide, with finely divided boron fuel, the invention gives compositions readily ignitable by flame, but which are thermally stable and which will withstand temperatures of up to 170°C for 2 hours at a pressure of 10 Torr.

These ignitable compositions may be used also as combustion promoters, for example as an addition to ethyl cellulose in a binder for conventional fuse head compositions of potassium chlorate and charcoal. They can be used as delay compositions, the consolidated material with 3 percent boron giving delays of the order of 0.2 second per centimeter length of delay column. Unlike other delay compositions with this rate of burning those provided by the invention ignite readily and donate to the next element in the delay train so extra priming and donating compositions are not required.

Particular examples of the manufacture, in accordance with the invention, of low and high bulk density ignitable compositions corresponding respectively to the orthorhombic and tetragonal crystalline polymorphic forms of lead oxide incorporating boron are as follows:

EXAMPLE 1

6.0g. of amorphous boron (around 1.0 micron particle size) are suspended in 1.2 liters of aqueous sodium hydroxide solution containing 0.32 mole sodium hydroxide. The suspension is stirred and heated to 90°C. 1.06 liters of lead nitrate solution containing 0.8 mole lead nitrate and 1.06 liter of sodium hydroxide solution containing 1.60 moles sodium hydroxide are added to the stirred suspension simultaneously and dropwise during 42 minutes, the temperature being maintained at 90°C during the precipitation. A further 15 minutes stirring after addition is given, the precipitated product settles quickly when the stirring is discontinued and the supernatant liquor is decanted hot. The boron is completely incorporated in the lead oxide orthorhombic crystals and the supernatant liquor is clear and free from elemental boron. The product is washed twice in the precipitating pan by decantation.

The product is transferred on to cambric cloth on a buchner funnel, sucked free of excess water, washed with methylated sprits and dried by passage of dry air or on a hot table at 60°C. The yield obtained is 180g. The product has a low bulk density of 0.4 g/ml and contains about 3 percent boron by weight. In appearance it ressembles aluminium flake and it readily burns when ignited in an open train.

EXAMPLE 2

The process described in Example 1 is carried out in an identical manner except that 22.5g. amorphous boron are initially suspended in the aqueous sodium hydroxide solution. 200g. of product are obtained, containing 10 percent boron by weight and having a low bulk density of 0.32 g/ml.

EXAMPLE 3

The preparation of the high bulk density tetragonal form of lead oxide incorporating boron is carried out in a simular manner to example 1 except that the lead nitrate solution is replaced by 1.06 liters of lead acetate solution containing 0.8 moles lead acetate trihydrate. This lead acetate solution is added simultaneously with 1.06 liters of sodium hydroxide solution containing 1.6 moles sodium hydroxide to a stirred suspension of 1.2 liters of sodium hydroxide solution (containing 0.32 moles sodium hydroxide) to which has been added 6g. of amorphous boron around 1.0 micron particle size. The yield is 170 g. of product having a high bulk density of 2.5 g/ml and a boron content of 2.67 percent by weight.

EXAMPLE 4

The process described in Example 3 is repeated with the quantities scaled up by a factor of ten. The yield is then 1.75 Kg of product having a high bulk density of 2.0 g/ml and a boron content of about 3.0 percent by weight.

High bulk density products containing 5 and 10 percent boron may be prepared in manner similar to that described in Example 3 using the appropriate weight of boron in suspension.

We claim:

1. An ignitable composition which comprises crystalline lead monoxide having up to about 10 percent by weight of finely divided boron entrained within, and substantially uniformly dispersed throughout, individual lead monoxide crystals.

2. A high bulk density ignitable composition consisting essentially of lead monoxide in the tetragonal polymorphic crystal form having up to about 10 percent by weight of finely divided boron entrained within, and substantially uniformly dispersed throughout, individual lead monoxide crystals.

3. A low bulk density ignitable composition consisting essentially in the orthorhombic polymorphic crystal form haing up to about 10 percent by weight of finely divided boron entrained within, and substantially uniformly dispersed throughout, individual lead monoxide crystals.

4. A method of making the product defined in claim 1 comprising forming crystalline lead monoxide in aqueous solution in the presence of a suspension of finely divided boron.

5. A process for preparing an ignitable composition as claimed in claim 1 which comprises reacting together a soluble lead salt and an alkali in an aqueous suspension of finely divided boron, whereby the ignitable composition is precipitated as crystalline lead monoxide containing entrained boron from the aqueous suspension.

6. A process according to claim 5 in which the soluble lead salt is lead acetate.

7. A process according to claim 5 in which the soluble lead salt is lead nitrate.

8. A process according to claim 5 in which the alkali is sodium hydroxide.

9. A process according to claim 5 and in which the soluble lead salt and the alkali are reacted at between 80° and 100°C.

* * * * *

UNITED STATES PATENT OFFICE

CERTIFICATE OF CORRECTION

Patent No. 3,954,530 Dated May 4, 1976

Inventor(s) Kenneth John Holloway; George William Charles Taylor; and Arwin Theophilus Thomas It is certified that error appears in the above-identified patent and that said Letters Patent are hereby corrected as shown below:

In the heading, insert:

Foreign Application Priority Data

March 8, 1966 Great Britain 10,216/66

In Claim 3, line 3, correct the spelling of "having".

Signed and Sealed this

Tenth Day of August 1976

[SEAL]

*Attest:*

RUTH C. MASON
*Attesting Officer*

C. MARSHALL DANN
*Commissioner of Patents and Trademarks*